United States Patent [19]

Robison

[11] 4,020,519

[45] May 3, 1977

[54] STATIONARY BACK SCRUBBER

[75] Inventor: Wayne B. Robison, Antioch, Calif.

[73] Assignee: Lawrence Peska Associates, Inc., New York, N.Y. ; a part interest

[22] Filed: Dec. 23, 1975

[21] Appl. No.: 643,694

[52] U.S. Cl. ..... 15/104.92; 4/158; 15/244 R

[51] Int. Cl.[2] ..... A47K 7/03

[58] Field of Search ..... 15/104.92, 244 R, 244 C; 4/158, 184; 128/65; 401/201; 239/42, 43

[56] References Cited

UNITED STATES PATENTS

| | | | |
|---|---|---|---|
| 727,993 | 5/1903 | Newport | 4/184 |
| 1,994,413 | 3/1935 | Webster | 4/184 |
| 2,827,651 | 3/1958 | Rizk | 4/184 UX |
| 3,085,269 | 4/1963 | Greer | 4/158 X |
| 3,209,372 | 10/1965 | Boyett et al. | 4/158 |
| 3,279,463 | 10/1966 | Krimmel | 128/62 R |
| 3,478,369 | 11/1969 | Ensley | 4/158 |
| 3,791,746 | 2/1974 | Yearka | 401/201 |

FOREIGN PATENTS OR APPLICATIONS

| | | | |
|---|---|---|---|
| 142 | 1/1914 | United Kingdom | 239/43 |

*Primary Examiner*—Daniel Blum

[57] ABSTRACT

A body scrubbing apparatus such as a stationary back scrubber is disclosed for attachment to a wall which comprises a resilient sponge device having a reservoir at the top thereof for gravity feeding liquid detergent from the reservoir to the bottom of the porous member of sponge. In one embodiment a sponge having a gradient density increasing from the reservoir downwardly toward the bottom of the porous member or a sponge is provided to minimize pooling or collection of liquid detergent at the bottom of the sponge or porous member.

7 Claims, 4 Drawing Figures

STATIONARY BACK SCRUBBER

BRIEF SUMMARY OF THE INVENTION

The present invention relates to a body scrubbing device for attachment to a wall and comprises a porous resilient member such as a sponge having a liquid detergent reservoir mounted at the top thereof for gravity-feeding liquid detergent downwardly through the porous member. A securing means is provided which is operatively connected to the back of the porous member in order to attach the body scrubbing apparatus to a wall surface. In one embodiment the reservoir is provided by mounting the porous member on a backing having a recess at the upper portion thereof, the upper portion of the porous member extending across the recess to thereby form the reservoir for a liquid detergent.

In yet another embodiment, the density of the porous member increases in a direction from the detergent reservoir towards the bottom of the porous member to minimize the pooling of liquid detergent at the bottom of the porous member. The porous member which increases in density may comprise a plurality of such members the edges of which are in an abutting relation for feeding liquid detergent from one porous member to another. In another embodiment, the density of each of said porous members beneath the porous member extending across the reservoir is greater than the density of the porous member immediately above it.

DETAILED DESCRIPTION

Body scrubbing devices or massaging devices are known in the prior art as illustrated in U.S. Pats. Nos. 3,750,226 Morgan; 3,631,560 Atkins; 3,612,044 Gurrola; 3,040,337 Fjelstad; 2.904,038 Hackney; 2,730,737 Herman; 1,645,926 Pfeufer; and, 585,086 Cos. The Hackney reference discloses specifically a sponge rubber or similar material for use as either a body massaging or a body scrubbing device. Devices of this type when used for body scrubbing purposes, suffer the disadvantage of not having means thereon for easily applying a detergent to it which is subsequently used in a body scrubbing procedure. The application of liquid detergents to porous resilient members such as sponges results in the pooling of the detergent at the bottom of the sponge due to the ability of the liquid detergent to work its way downwardly through the sponge by means of gravity. In applying a liquid detergent to a sponge, the detergent in some instances has a tendency to collect below the point of application in a large pool after a period of time and upon the application of the detergent to the body in a scrubbing operation, the pooled detergent tends to be squeezed from the sponge in such quantities that it is not efficiently used in a body-scrubbing procedure.

It is therefore an object of the present invention to overcome these and other difficulties encountered in the prior art. It is a further object of the present invention to provide a body scrubbing apparatus for attachment to a wall which has a reservoir therein for metering out a liquid detergent downwardly along the length of the porous member.

It is a further object of the present invention to provide a body scrubbing apparatus for attachment to a wall comprising a porous resilient member which substantially avoids the difficulty of pooling of a liquid detergent at the bottom of the porous member.

These and other objects have been achieved by the present invention and will become apparent by reference to the disclosure and claims that follow as well as the appended drawing.

Figure 1:
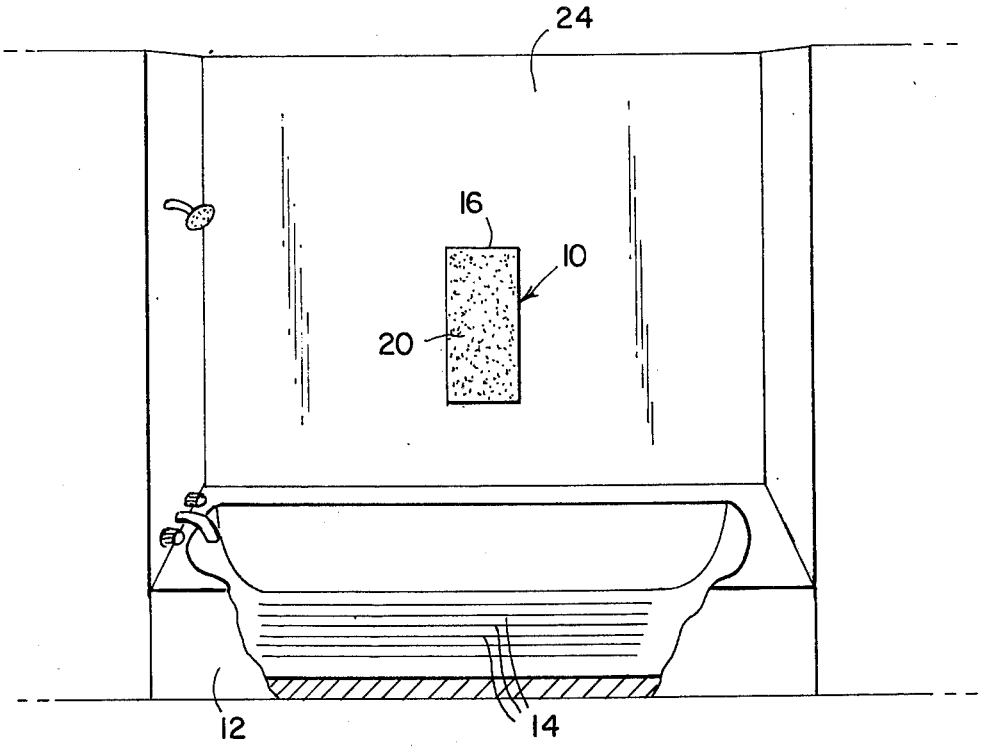
FIG. 1 is a perspective view partially in section illustrating an embodiment of the body scrubbing apparatus affixed to the center wall of a combination bathtub and shower stall, no-skid being provided on the base of the bathtub to prevent slipping when employing the body scrubbing apparatus according to one embodiment.
Figure 2:
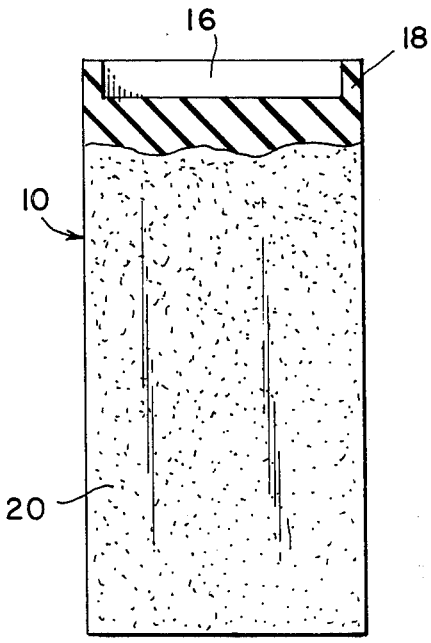
FIG. 2 is a front elevation partially in section of the body scrubbing apparatus and illustrates a liquid detergent reservoir at the top of the apparatus according to said embodiment.
Figure 3:
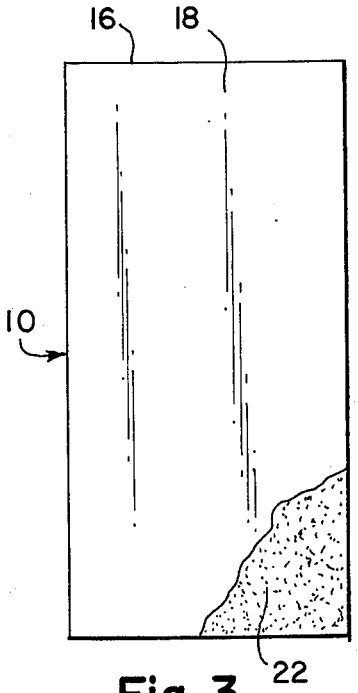
FIG. 3 is a back elevation illustrating the waterproof adhesive means on the back of the body-scrubbing apparatus for securing the apparatus to a wall member according to said embodiment.
Figure 4:
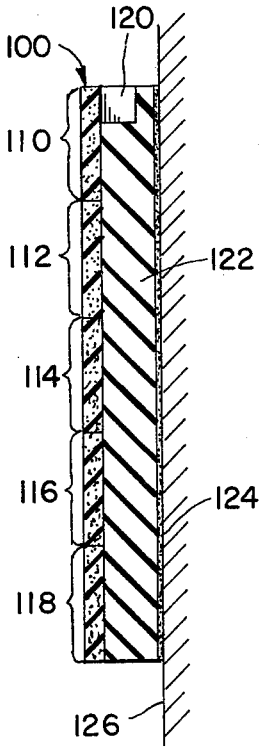
FIG. 4 is a side elevation in section illustrating a plurality of porous members the edges of which are in an abutting relation for feeding liquid detergent from one porous member to another, the density of each of the porous members increasing in a direction from the detergent reservoir downward or each of the porous members beneath the porous member extending across the reservoir being greater than the density of the porous member immediately above it according to the preferred embodiment of the present invention.

Referring to the drawing and FIGS. 1 through 4, a body scrubbing apparatus 10 and 100, for attachment to a wall is disclosed comprising an absorbent porous resilient member 20 having a liquid detergent reservoir 16 at the top thereof. Porous member 20 comprises a rubber sponge or a polyurethane sponge both of which are known in the art or the equivalents thereof. The porous member 20 is mounted on a resilient backing 18 such as a soft rubber backing 18, the reservoir 16 being formed in one instance by providing a recess in the upper portion of backing 18, the upper portion of the sponge or porous member 20 extending across the recess to thereby form a reservoir 16. Reservoir 16 in any event is mounted at the top of the apparatus 10 for gravity feeding liquid detergent downwardly through the porous member 20. A securing member such as an adhesive backing, especially a waterproof adhesive backing 22 is provided on the back of backing 18, the adhesive being used to secure the apparatus 10 to a wall as illustrated in FIG. 1, especially a wall in a shower stall or above a bathtub 12, the bathtub having non-skid strips 14 at the bottom thereof so that when in use as a back scrubbing device, slipping is substantially minimized or avoided.

In another embodiment, a body scrubbing apparatus 100 is provided having a liquid detergent reservoir 120 and a porous resilient member having zones 110, 112, 114, 116 and 118 of increasing or gradient density whereby the density increases downwardly from the reservoir 120 toward the direction of the bottom of the scrubbing apparatus 100, zone 118 being higher in density than zone 110. The gradient density across zones 110 through 118 is provided to minimize or substantially minimize pooling of the detergent at the bottom of the porous means, i.e., pooling in the area of zone 118 when liquid detergent is placed in reservoir 120 and allowed to feed into the zones 110 through 118 by capillary action and gravity.

Individual sponge or porous means 110, 112, 114, 116 and 118 may also be provided in lieu of a continuous resilient member having a gradient density through zones 110 down to zone 118. The individual resilient members 110 through 118 are joined one to the other at the edges thereof, the edges being in an abutting relation for feeding liquid detergent from one porous member to another. In one embodiment the density of each porous member 110, 112, 114, 116 and 118 increases in a direction from the top of each individual member downwardly to the next individual member, ie., the density at the top of member 110 is less than the density at the bottom of member 110, the density at the top of member 112 is greater than the density of bottom of member 112, and similarly for members 114, 116 and 118. In yet another embodiment, the density of each member 110, 112, 114, 116 and 118 is uniform; however, the density of member 110 is less than the density of member 112, the density of member 112 is less than the density of member 114 and similarly for members 116 and 118.

An adhesive backing such as a waterproof adhesive backing 124 is provided on resilient backing 122 to which the porous resilient member having either zones 110 through 118 or comprising a plurality of resilient members 110 through 118 is secured.

In use the body scrubbing apparatus 10 may be adhered to a wall as illustrated in FIG. 1 or the body scrubbing apparatus 100 may be adhered to a wall 126 and in either case a liquid detergent may be introduced into reservoir 16 or 120 respectively. The arrangement of the reservoir 16 at the top of body scrubbing apparatus 10 rather than along the full length from top to bottom of body scrubbing apparatus 10 prevents the pooling of detergent at the bottom thereof. Furthermore, by providing the gradient densities across zones 110 through 118 of the body scrubbing apparatus 100 or by providing a plurality of porous members 110 through 118 as previously described when in combination with the reservoir 120 provided at the top of body scrubbing apparatus 100 will further minimize or substantially eliminate the pooling of liquid detergent at the bottom thereof. By moving their back over the surface of body scrubbing apparatus 10 or 100 after wetting and after the body scrubbing apparatus has been filled with detergent, a lather may be built up by a bather and the porous member of the apparatus 10 or 100 employed to scrub the back.

Although the invention has been described by reference to some embodiments it is not intended that the body scrubbing apparatus be limited thereby but that certain modifications thereof are intended to be included as falling within the broad spirit and scope of the foregoing disclosure, the following claims and the appended drawing.

What is claimed is:

1. A body scrubbing apparatus for attachment to a wall comprising a an absorbent resilient scrubbing means, said abosrbent scrubbing means having liquid detergent reservoir means mounted at the top thereof for gravity feeding liquid detergent downwardly through said absorbent scrubbing means, the density of said absorbent scrubbing means increasing in a direction from said detergent reservoir means towards the bottom of said absorbent scrubbing means to minimize the pooling of liquid detergent at the bottom of said absorbent scrubbing means, wall securing means operativey connected to the back of said absorbent means for attachment to a wall surface, said absorbent scrubbing means is mounted on backing means, the upper portion of said backing means having recess means therein, the upper portion of said absorbent scrubbing means extending across said recess to thereby form said reservoir for a liquid detergent, said backing means having said wall securing means on the face thereof opposite said absorbent scrubbing means.

2. The body scrubbing apparatus of claim 1 where said backing means comprises a resilient backing.

3. The body scrubbing apparatus of claim 2 where said securing means comprises a substantially waterproof adhesive.

4. The body scrubbng apparatus of claim 1 where said absorbent scrubbing means comprises a plurality of abosrbent scrubbing elements extending laterally to form opposed substantially horizontal edges, said edges of each being in an abutting relation for feeding liquid detergent from one absorbent scrubbing element to another, the density of each of said absorbent scrubbing elements increasing in a direction from said detergent reservoir toward the bottom of said absorbent scrubbing means to minimize the pooling of liquid detergent at the bottom of said abosrbent scrubbing means.

5. The body scrubbing apparatus of claim 1 where said absorbent scrubbing means comprises a plurality of absorbent scrubbing elements extending laterally to form opposed substantially horizontal edges, said edges of each being in an abutting relation for feeding liquid detergent from one abosrbent scrubbing element to another, the density of each of said abosrbent scrubbing elements beneath the absorbent scrubbing element extending across said reservoir being greater than the density of said abosrbent scrubbing element immediately above it to minimize the pooling of liquid detergent at the bottom of said body scrubbing apparatus.

6. The body scrubbing apparatus of claim 4 where said backing means comprises a resilient backing and said securing means comprises a substantially waterproof adhesive.

7. The body scrubbing apparatus of claim 5 where said backing means comprises a resilient backing and said securing means comprise a substantially waterproof adhesive.

* * * * *